United States Patent [19]

Eck et al.

[11] 4,074,627

[45] Feb. 21, 1978

[54] APPARATUS FOR PREVENTING NON-UNIFORM APPLICATION OF INK

[75] Inventors: Norbert Otto Eck, Zell; Siegfried Alfons Stark, Rottendorf; Erich Georg Wieland, Wurzburg, all of Germany

[73] Assignee: Koenig & Bauer Aktiengesellschaft, Wurzburg, Germany

[21] Appl. No.: 747,750

[22] Filed: Dec. 6, 1976

[30] Foreign Application Priority Data

Dec. 12, 1975 Germany ..... 2555993

[51] Int. Cl.[2] ..... B41F 35/00

[52] U.S. Cl. ..... 101/425; 101/365; 101/168

[58] Field of Search ..... 101/425, 423, 156, 168, 101/160, 162, 164, 165, 166, 350, 363, 365, 157, 169; 118/104, 203, 261

[56] References Cited

U.S. PATENT DOCUMENTS

| | | | |
|---|---|---|---|
| 549,976 | 11/1895 | Robertson | 101/169 X |
| 794,487 | 7/1905 | Brod | 101/425 |
| 2,404,350 | 7/1946 | Carlsen | 101/425 |
| 2,655,104 | 10/1953 | Jobb | 101/365 |
| 3,049,997 | 8/1962 | Grembecki et al. | 101/425 |
| 3,164,087 | 1/1965 | Owen | 101/425 X |
| 3,800,702 | 4/1974 | Roberts | 118/203 |
| 3,888,172 | 6/1975 | D'Amato et al. | 101/156 |

*Primary Examiner*—J. Reed Fisher

*Attorney, Agent, or Firm*—Jones, Tullar & Cooper

[57] ABSTRACT

Apparatus for removing buildup of high viscosity printing inks from the edge of a doctor blade in an inking fountain used in a rotary printing press is disclosed. A moving cleaning web or sheet is supported in spaced relation to the edge of the doctor blade by a conducting blade whose position is adjustable both horizontally and vertically. Buildup of high viscosity ink at the edge of the doctor blade is eliminated as the built up particles of ink are picked up and carried away by the moving cleaning web or ink wiper which may be either an endless web or a disposable roll of material.

10 Claims, 4 Drawing Figures

APPARATUS FOR PREVENTING NON-UNIFORM APPLICATION OF INK

FIELD OF THE INVENTION

The present invention is directed generally to an apparatus in rotary printing presses for preventing non-uniform application of ink on the printing forme. More particularly, the present invention is directed to such an apparatus which removes built up ink from the doctor blade in an inking well. Specifically, the present invention is directed to an apparatus utilizing a cleaning web which carries the built up particles of ink away from the doctor blade, thus preventing the ink particles from being transferred to the printing forme. A moving, cleaning web is moved in a transverse direction past the edge of a doctor blade in an inking fountain assembly portion of a rotary printing press. The cleaning web is supported by a conducting or support blade adjacent the doctor blade with the support blade being capable of horizontal and vertical movement. The web of cleaning material, in either an endless web or strip form, passes over the support blade, contacts the built up ink particles on the doctor blade, and carries these particles away from the blade thereby preventing them from being carried onto the printing forme and to the material being printed.

DESCRIPTION OF THE PRIOR ART

Ink fountains for use with rotary printing presses are generally well known in the prior art, as shown in German Pat Nos. 1,269,139 and 1,924,443. One disadvantage of these ink fountains is the impossibility of preventing the buildup of ink on the outer side of the fountain when they are used with inks having higher viscosities; i.e., inks having a dynamic viscosity of up to 800 poise. These built up particles of ink separate from the doctor blade at irregular intervals, are picked up by the ink fountain roller and thus get into the inking system of the rotary printing press.

The inking systems which utilize inks of higher viscosities are usually so-called short inking systems which are systems that are not capable of spreading and distributing the undesired particles of built up ink once they come loose from the doctor blade. Since these particles of ink are carried into the printing press without being dispersed, they are apt to appear in the printed sheets as variations in the tonal value of the colors. Inks of high viscosity are used most frequently in the printing of security papers wherein variations in tonal quality cannot be permitted for reasons of safety against counterfeiting. Therefore any printed security papers which do show such tonal variations caused by built up particles of ink must be disposed of as waste sheets.

SUMMARY OF THE INVENTION

It is an object of the present invention to provide an apparatus for preventing the undue buildup of ink on the doctor blade of an inking fountain in a rotary printing press.

A further object of the present invention is to provide an apparatus for removing built up particles of ink from the doctor blade and for disposing of these ink particles.

Yet another object of the present invention is to provide an apparatus for removing built up particles of ink from the doctor blade in which the ink is contacted by a moving cleaning web passing over a support blade adjacent the doctor blade.

The apparatus in accordance with the present invention includes a support blade supported capable of both horizontal and vertical movement adjacent to the outer edge of a doctor blade in a known ink fountain. A movable cleaning web, either an endless, cleanable belt or a length of disposable material, is passed transversely across the support blade to contact the built up particles of ink carried on the outer edge of the doctor blade and to carry the particles of ink away. Since these particles of ink are removed from the doctor blade before they are transferred to the printing forme, the quantity of waste printed sheets is substantially reduced. Accordingly, the present invention facilitates the use of high viscosity printing inks in short inking systems with many less waste sheets than has been possible previously.

BRIEF DESCRIPTION OF THE DRAWINGS

While the novel features of the present invention are set forth with particularity in the appended claims, a full and complete understanding of the present invention may be had by referring to the description of a preferred embodiment as set forth hereinafter and as may be seen in the accompanying drawings in which:

DESCRIPTION OF A PREFERRED EMBODIMENT

Figure 1:
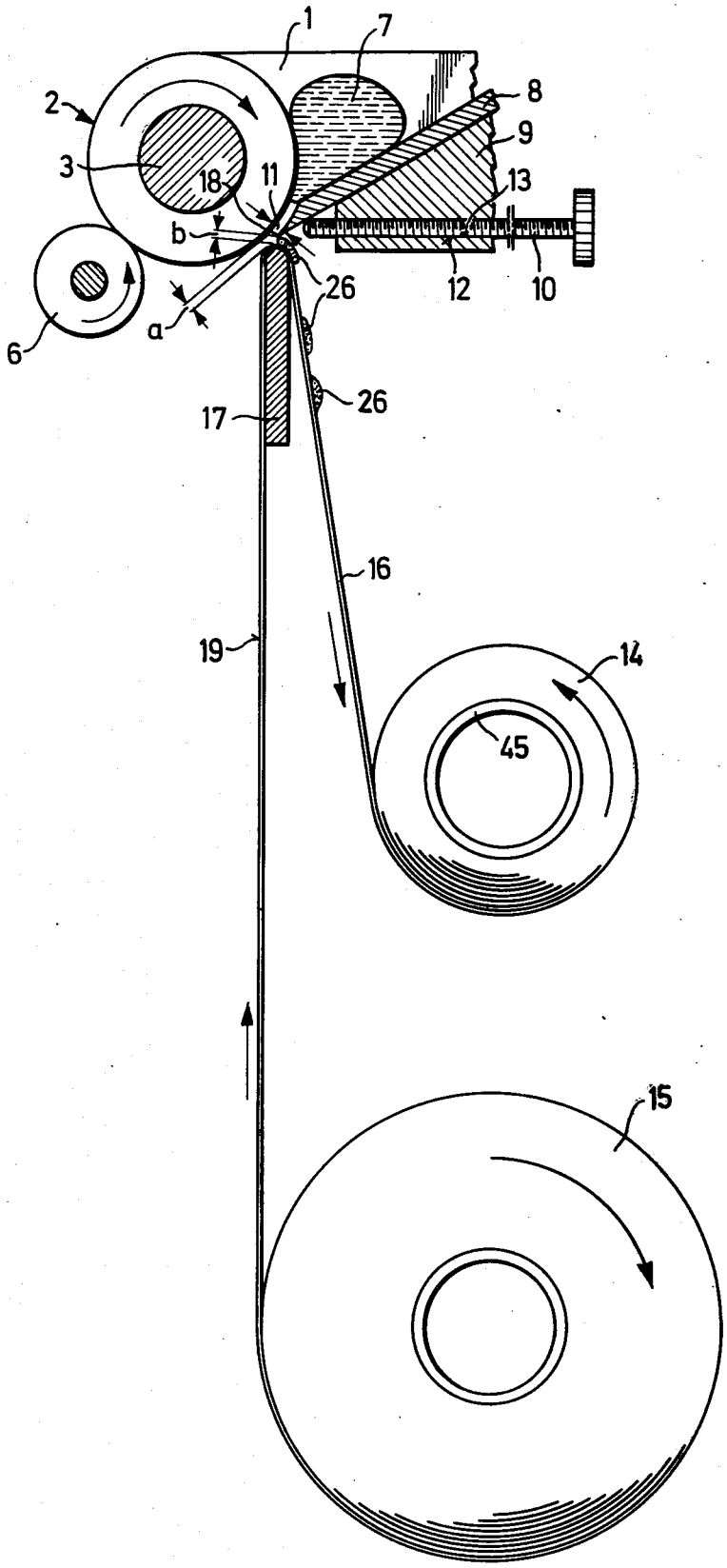
FIG. 1 is a schematic side elevation view of an apparatus for preventing the non-uniform application of ink in accordance with the present invention.

Turning now to FIG. 1 there may be seen generally at 1 a conventional ink fountain that includes an ink fountain roller 2 which rotates in a clockwise direction. The ink fountain roller 2 is carried by a shaft 3 which is supported in a conventional manner in side frames 4 and 5 of a rotary printing press, as may be seen in FIG. 2. The ink fountain roller is driven by suitable means (not shown) and cooperates with one or more inking cylinders 6 to apply ink to a printing forme (not shown). An amount of high viscosity ink 7 is carried in fountain 1 and the amount of this ink 7 which is transferred to the inking cylinder 6 is controlled by a doctor blade 8, again as may be seen in FIG. 1. The ink passes through an ink gap 11 with the amount of ink dispensed being dependent on the width of the ink gap 11. The width of this gap may be adjusted by means of adjusting screws 10 which can be tightened or loosened to vary the gap, as may be seen in FIG. 1, since the threads 12 of the adjusting screws 10 cooperate with threads 13 of the doctor blade support 9. This ink fountain assembly is well known in the prior art and is meant as exemplary of a number of generally similar devices.

Referring again to FIG. 1, a first preferred embodiment of an apparatus for preventing non-uniform application of ink in accordance with the present invention is shown in which a rewinding reel 14 draws a length of flexible web material 16 and from a supply web reel 15 over a conducting or support blade 17. The conducting blade 17 is provided below the doctor blade 8 and is parallel to the extreme edge 18 of the doctor blade 8 as well as to the axis of rotation of the ink fountain roller 2. The ink wiping surface 19 of the web material 16 should be conveyed as close as possible, a distance "*a*" of 0.1 to 3 mm, to the surface of the ink fountain roller 2 as well as to the extreme edge 18 of the doctor blade 8, a distance "*b*" of 0.1 to 3 mm thereby removing the unwanted buildup of ink particles 26. For the purpose of varying the distance of the conducting blade 17 and thus of the web material 16 from the surface of the ink fountain roller 2 and the extreme edge 18 of the doctor blade, the conducting blade 17 is capable of being adjusted in the horizontal as well as in the vertical directions. The web material 16 may be of paper, textile, or plastic material and web 16 may be either of finite length, or may be endless.

Figure 4:
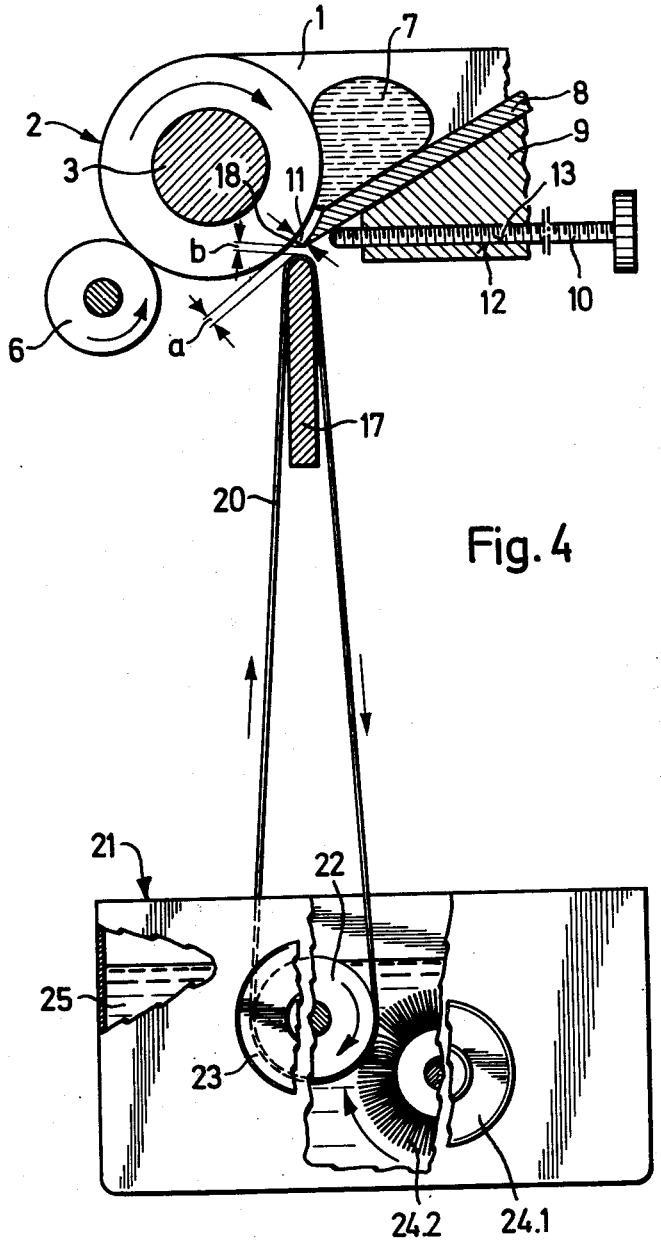
FIG. 4 is a schematic side elevation view of a second embodiment of an apparatus for preventing non-uniform application of ink in accordance with the present invention.

As is shown in a second preferred embodiment, as seen in FIG. 4, an endless tape 20 may be used as the cleaning web with this tape 20 passing around the conducting blade 17, and being cleaned by a cleaning system 21. A conveyor cylinder 22, driven by a geared motor 23, is used for the drive of the endless tape 20. A rotating brush 24.2, driven by an electric motor 24.1 is immersed in a solvent 25, moistens the endless tape 20, and removes the ink from the surface of the endless tape 20.

Figure 2:
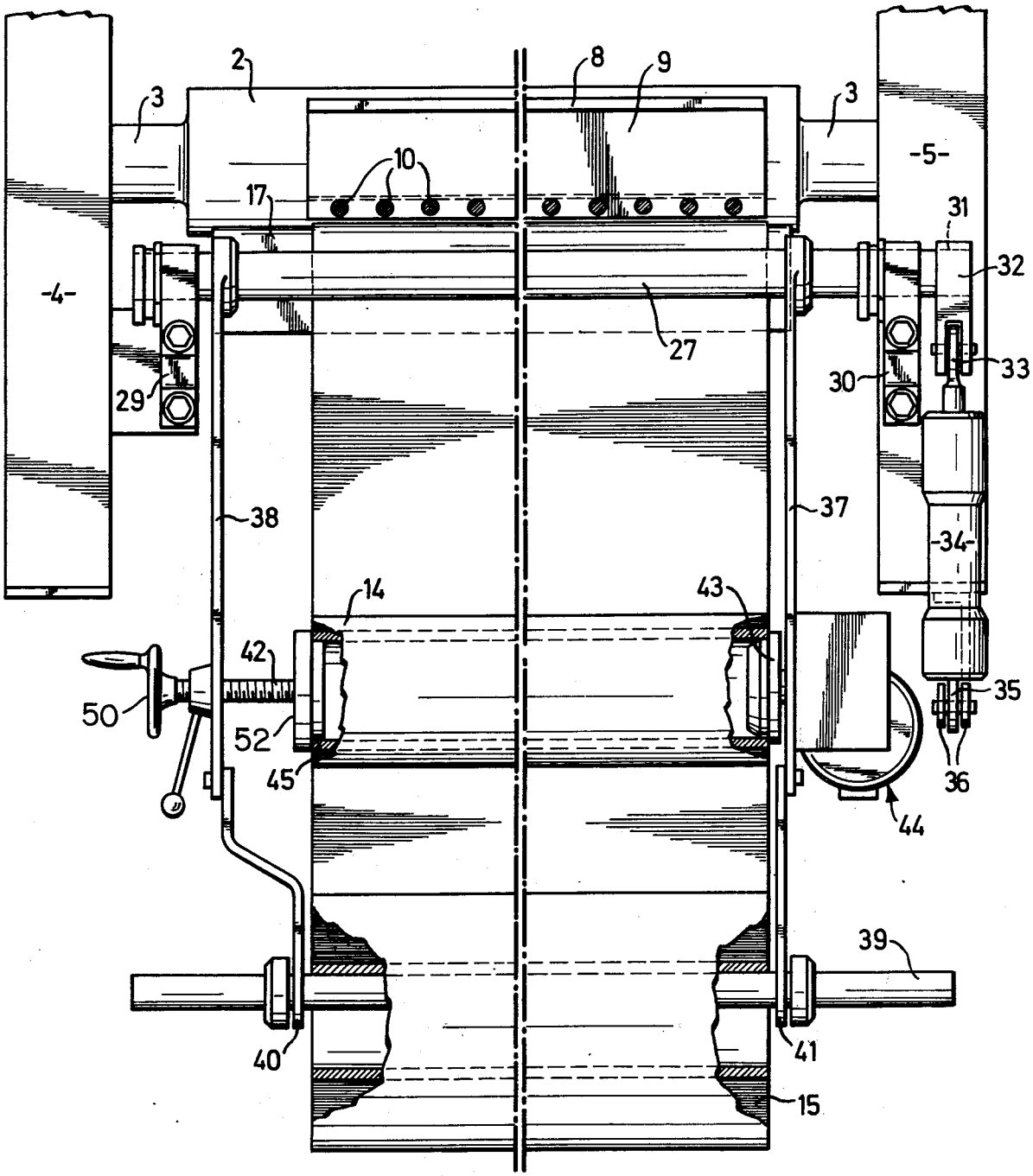
FIG. 2 is a front elevation view of an apparatus in accordance with the present invention.
Figure 3:
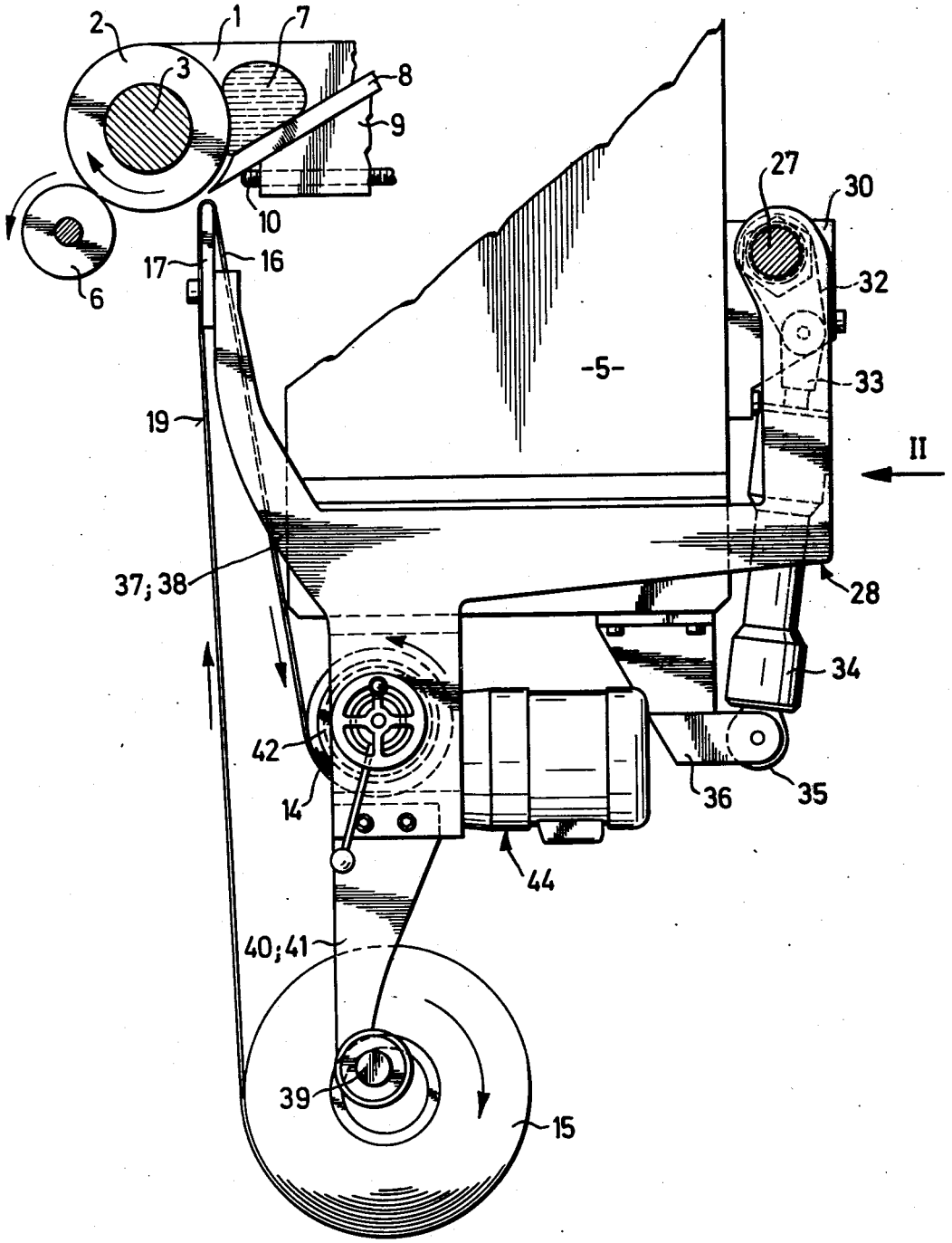
FIG. 3 is a side elevation view of the apparatus of FIG. 2.

Returning to the first preferred embodiment as seen in FIGS. 1, 2, and 3, the supply web reel 15 and the rewinding reel 14 are capable of being swung around a spindle 27 in a swinging frame 28. The spindle 27 is carried by bearings in a pair of bearing brackets 29, 30, which are bolted or similarly secured to the side frames 4 and 5, respectively. The swinging frame 28 is keyed to the spindle 27 and an arm 32 is affixed to the spindle end 31. A piston rod head 33 of a controlled hydraulic cylinder 34 is connected with the arm 32, and an end bearing 35 of cylinder 34 is joined to a cantilever arm 36 secured to the side frame 5. The conducting blade 17 is screwed to a pair of arms 37, 38 and a spindle 39, which carries the supply web reel 15, is suspended in a pair of hooks 40, 41. An extensible and retractable shaft 42, movable by a handwheel 50, as may be seen in FIG. 2, carries a hub 52 which is engagable with one end of the rewind spool 45 of rewind reel 14. A second hub 43 is driven by a suitable motor 44 and when the rewind spool 45 is secured between hubs 43 and 52, actuation of the drive motor 44 will pull the web material 16 from the supply reel 15 transversely across the support blade 17 and onto the rewind reel 14. Actuation of the hydraulic cylinder 34 causes movement of the support blade 17 toward or away from the outer edge of the doctor blade 8 and the support blade 17 is secured to arms 37 and 38 by suitable means, (not shown) whereby the horizontal position of the support blade can be varied, all to insure that support blade 17 is properly positioned so that the unwanted particles of ink 26 will be picked up by the moving web 16 and carried away from the fountain roller and inking cylinder before they are able to cause variation in the tonal values of the colors.

Thus it will be seen that a full and complete description of an apparatus for preventing the non-uniform application of ink in accordance with the present invention has been set forth hereinabove. It will, however, be obvious to one of skill in the art that a number of changes in for example, the ink fountain, the type of cleaning web, the various drive means and the like could be made without departing from the true spirit of the invention and that accordingly, the present invention is to be limited only by the following claims.

We claim:

1. Apparatus for preventing the unwanted build up of particles of printing ink on the edge of a doctor blade in an ink fountain for a rotary printing press and for removing any built up particles, said apparatus comprising:

a support blade generally parallel with the edge of the doctor blade, said support blade being positioned closely adjacent to but spaced from the doctor blade;

a movable cleaning web advanceable transversely over said support blade and close to the edge of the doctor blade to contact built up ink particles and remove the built up ink particles from the doctor blade;

means for advancing said cleaning web; and means for varying the position of said support blade with respect to the doctor blade to vary the spacing of said support blade from the doctor blade.

2. The apparatus of claim 1 wherein said cleaning web is an endless flexible web.

3. The apparatus of claim 2 further including means to clean ink particles from said endless flexible web.

4. The apparatus of claim 1 wherein said cleaning web is a length of flexible web.

5. The apparatus of claim 4 wherein said length of flexible web is advanced over said support blade from a supply web reel to a rewind reel.

6. The apparatus of claim 5, wherein said means for advancing said flexible web is a drive motor for rotating said rewind reel.

7. The apparatus of claim 4 further wherein said means for varying the position of said support blade includes a swinging frame secured to the side frames of the printing press.

8. The apparatus of claim 7 further including a hydraulic cylinder to position said swinging frame.

9. The apparatus of claim 7 further wherein said flexible web is advanced over said support blade from a supply web reel to a rewind reel, said supply and rewind reels being secured to said swinging frame.

10. The apparatus of claim 9 wherein said means for advancing said flexible web is a drive motor for rotating said rewind reel, said drive motor being secured to said swinging frame.

* * * * *